United States Patent [19]

McGarry et al.

[11] 4,401,609

[45] Aug. 30, 1983

[54] METAL ATOMIZATION

[75] Inventors: Dennis L. McGarry, Granville; Frederick K. Roehrig, Columbus, both of Ohio

[73] Assignee: Owens-Corning Fiberglas Corporation, Toledo, Ohio

[21] Appl. No.: 322,802

[22] Filed: Nov. 19, 1981

[51] Int. Cl.[3] ..... B01J 2/06

[52] U.S. Cl. ..... 264/11; 264/12

[58] Field of Search ..... 264/11, 12

[56] References Cited

U.S. PATENT DOCUMENTS 3,771,929 11/1973 Hellman et al. ..... 264/12

3,813,196 5/1974 Backstrom et al. ..... 264/12

*Primary Examiner*—James R. Hall

*Attorney, Agent, or Firm*—Ronald C. Hudgens; Patrick P. Pacella; Philip R. Cloutier

[57] ABSTRACT

An increase in fine particle metal production is realized when the descending molten metal stream is caused to impinge upon one of two descending fluid streams at a locus offset from the locus of intersection of the two descending fluid streams.

5 Claims, 1 Drawing Figure

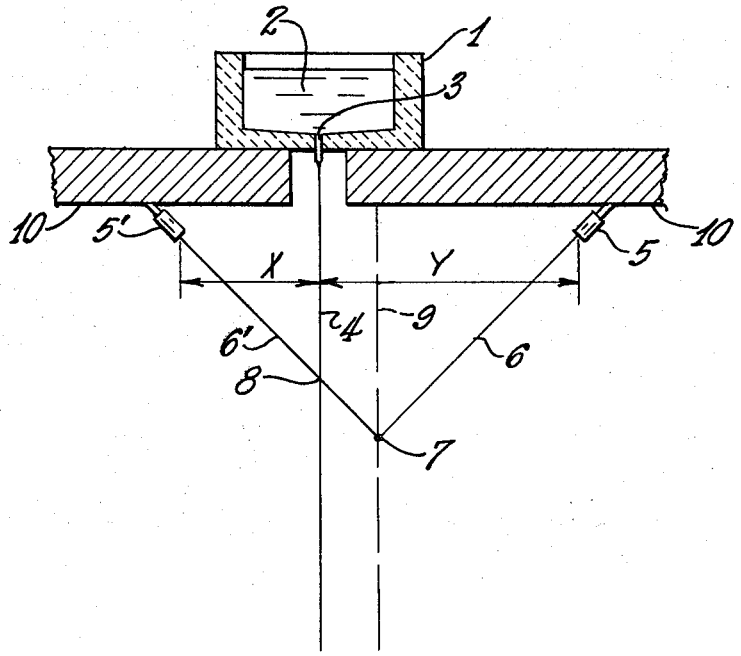
2
1
3
10
5'
5
10
X
Y
4
9
6'
6
8
7

METAL ATOMIZATION

TECHNICAL FIELD

This invention pertains to metal atomization.

In one of its more specific aspects, this invention relates to impacting a metal stream on fluid streams to produce fine metal particles.

BACKGROUND OF THE INVENTION

In certain metallurgical processing there is a need for very fine metallic particles. While there are a number of methods of producing such particles, or powders, one of the principal methods involves an impingement process in which the metal, in molten form, is impinged upon high pressure fluid streams, either liquid or gases, with the result that particles of metals as small as 400 mesh (less than 37 microns) are produced.

In the aforementioned process, two or more high pressure jets of gas or liquid are directed downwardly into contact with each other. A stream of molten metal, one for each pair of high pressure jets, is dropped downwardly to intersect the streams at their point of intersection, or apex. The result is that the stream of molten metal is, in effect, shattered into fragments, some portion of which are fines of the desired particle size. Particles larger than the desired size are separated and recycled. The efficiency of the process is measured by the amount of fines produced, that is, particles less than 37 microns in size.

STATEMENT OF INVENTION

There has now been discovered a method of increasing the production of metallic fines by impingement of molten metal streams upon converging fluid streams which comprises impinging the molten metal stream on at least one of the converging fluid streams at a locus offset from the locus of convergence of the fluid streams.

BRIEF DESCRIPTION OF THE DRAWING

The attached FIGURE is a schematic representation of one method of carrying out this invention.

DETAILED DESCRIPTION OF THE INVENTION

The method of this invention is applicable to any metal. It is particularly suitable for use in pulverizing precious metals such as platinum.

The metal can be at any suitable temperature above its melting point. For example, platinum is preferably discharged into contact with the converging fluid streams at a temperature within the range of from about 3500° F. to about 3700° F. at a flow rate of about 6.75 to about 9.5 pounds per hour as a stream having a diameter of between about 30 to about 45 mils, preferably about 32 mils.

The method of this invention can be carried out employing any fluid, or fluids, on which the molten metal stream is impinged. Preferably, the invention will employ water at about room temperature, the water being emitted as a flat fan jet of about 20° to about 40° at a pressure of about 800 psi. The nozzles from which the water is discharged will be angled downward at about 60° from the horizontal. At least two fluid streams will be employed for each molten metal stream, but more than two streams can be impinged at a locus. It is preferred that the impinging fluid streams be of equal quantities, that is of about 600 to about 900 gallons per hour at the above specified metal rates.

Referring now to the attached FIGURE, there is shown crucible 1 having molten metal 2 positioned therein. The crucible is supported by suitable means 10. Positioned proximate the underside of support means 10 are nozzles 5 and 5', each of which discharge fluid stream 6 and 6', respectively, the fluid streams impinging at locus 7. Emitted from aperture 3 of crucible 1 is a stream of molten metal 4 which impinges upon fluid stream 6' at locus 8 rather than at the locus 7, the point of impingement of the fluid streams.

From the drawing it will be seen that stream 4 does not fall along that vertical imaginary line 9 passing through locus 7 perpendicular to the crucible. Instead, stream 4 is displaced therefrom, being a distance X from nozzle 5', the nearest nozzle, along a line intersecting the discharges of nozzles 5 and 5'. The ratio between the distance X of the descending metal stream from the nearest nozzle to the distance between nozzles, X plus Y, is known as the offset ratio. In all instances, this ratio will be less than 0.5, it being 0.5 when the path of the descending metal stream intersects the point of impingement of the fluid streams. In the practice of this invention, this offset ratio will be maintained at less than 0.50, preferably at between about 0.45 and about 0.20, and more preferably at between 0.25 and about 0.20.

EXAMPLE I

Molten platinum was discharged vertically downward from a crucible through a 0.032 inch diameter aperture. The platinum was under a pressure equivalent to the static head of the metal.

The fluid nozzles were positioned to discharge water downwardly at an angle of 60° from the horizontal.

Measurements were made of the yield of −400 mesh powder (less than 37 microns) at each of a plurality of offset ratios, with the following results:

| Offset Ratio | Avg. Yield | No. of Determinations |
|---|---|---|
| 0.21 | 53 | 2 |
| 0.22 | 48 | 1 |
| 0.24 | 55 | 1 |
| 0.25 | 56 | 1 |
| 0.26 | 53.5 | 1 |
| 0.27 | 51.2 | 2 |
| 0.28 | 54.5 | 2 |
| 0.30 | 54 | 1 |
| 0.33 | 59 | 1 |
| 0.34 | 48.5 | 1 |
| 0.50 | 33.5 | 1 |
| 0.23* | 51 | 3 |

*Positioned on opposite side.

The above data demonstrate that at offset ratios less than 0.50, considerable improvement in the yield of smaller than 400 mesh powder is realized.

It will be evident from the foregoing that various modifications can be made to this invention. Such, however, are considered within the scope of the invention.

We claim:

1. A method of producing fine platinum metallic particles comprising discharging a molten metal stream into contact with one of two intersecting high pressure jets of water at an offset ratio of less than 0.50, said offset ratio being defined as $$X/(X+Y)$$

in which

X is the horizontal distance between the discharging metal stream and the locus of discharge of the nearest water stream, and (X+Y) is the horizontal distance between the locii of discharge of said water streams to produce metallic particles as small as 400 mesh, the molten stream being discharged into contact with said jets through an aperture having a diameter of between about 30 and about 45 mils, said water being discharged as flat fan jets angled downwardly at about 60° from the horizontal.

2. The method of claim 1 in which said water is discharged at a pressure of about 800 pounds per square inch.

3. The method of claim 1 in which said offset ratio is between about 0.45 and about 0.20.

4. The method of claim 1 in which said offset ratio is between about 0.25 and about 0.20.

5. A method of producing fine metallic particles comprising discharging a molten metal stream through an aperture having a diameter of 0.032 inch into contact with one of two intersecting high pressure jets of water at an offset ratio between about 0.25 and about 0.20, said offset ratio being defined as $$X/(X+Y)$$

in which

X is the horizontal distance between the discharging metal stream and the locus of discharge of the nearest water stream and X+Y is the horizontal distance between the locii of discharge of said water streams, to produce metallic particles as small as 400 mesh.

* * * * *